United States Patent [19]

Waas et al.

[11] Patent Number: 4,743,179

[45] Date of Patent: May 10, 1988

[54] ELECTROMAGNETICALLY ACTIVATED PISTON PUMP

[75] Inventors: Peter Waas; Bernhard Matschull, both of Munich; Wolfgang Baeuml, Eichenau; Wolfgang Beck; Siegfried Piegsa, both of Munich, all of Fed. Rep. of Germany

[73] Assignee: Webasto-Werk W. Baier GmbH & Co., Gauting, Fed. Rep. of Germany

[21] Appl. No.: 829,082

[22] Filed: Feb. 13, 1986

[30] Foreign Application Priority Data

Feb. 13, 1985 [DE] Fed. Rep. of Germany ..... 3504789

[51] Int. Cl.[4] ..... F04B 17/00

[52] U.S. Cl. ..... 417/415; 417/559

[58] Field of Search ..... 417/415, 416, 417, 545, 417/552, 559; 92/85 R

[56] References Cited

U.S. PATENT DOCUMENTS

| | | | |
|---|---|---|---|
| 3,877,841 | 4/1975 | Nakamura | 417/417 |
| 4,101,950 | 7/1978 | Hager et al. | 417/417 |
| 4,272,225 | 6/1981 | Fujinaka et al. | 417/417 |
| 4,388,047 | 6/1983 | Mizuno et al. | 417/417 |
| 4,416,594 | 11/1983 | Ichikawa | 417/417 |

FOREIGN PATENT DOCUMENTS

| | | | |
|---|---|---|---|
| 2315842 | 10/1974 | Fed. Rep. of Germany . | |
| 2366301 | 1/1983 | Fed. Rep. of Germany | 417/417 |

*Primary Examiner*—Carlton R. Croyle
*Assistant Examiner*—Timothy S. Thorpe
*Attorney, Agent, or Firm*—Sixbey, Friedman & Leedom

[57] ABSTRACT

A piston pump, in accordance with several embodiments, comprises a suction chamber into which fluid medium enters from an inlet line via a suction valve, beginning at the outset of a delivery stroke of the piston pump, without a build-up of intake negative pressure during the delivery stroke of the piston, and is particularly adapted to prevent vapor bubble formation. A reliable pump closure is ensured in the vicinity of the pump outlet, independent of the spring action of a return spring, which bears against the piston, in that any fluid medium entering the suction chamber of the pump contacts the piston in a direction producing reinforcement of the outlet closure pressure. In accordance with preferred embodiments, the piston may be a partially hollow or entirely hollow piston instead of a solid one. Variously designed connecting elements and relief valve arrangements for the conducting of the fluid medium from the suction chamber of the fuel pump to an armature compartment are provided, with the objective that the piston pump have a minimum inactive flow volume.

29 Claims, 5 Drawing Sheets

FIG. 2
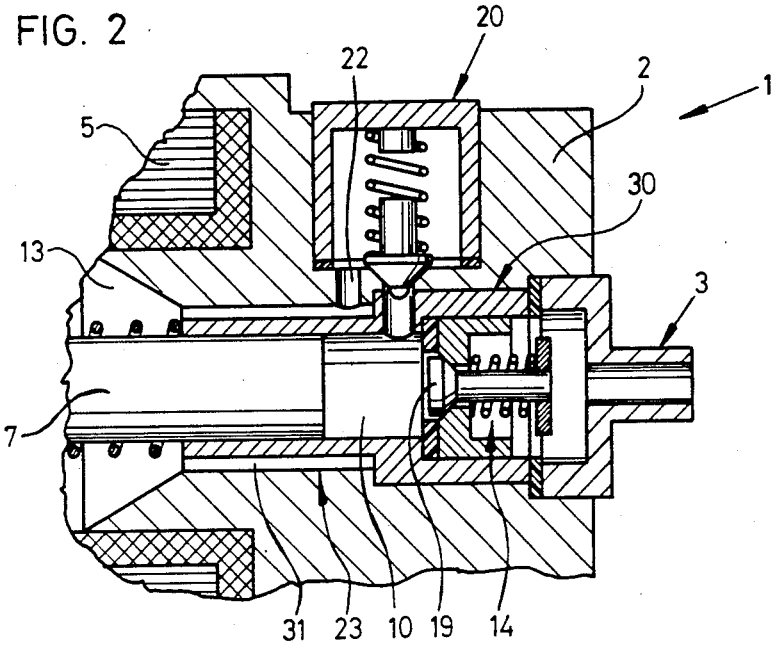
FIG. 4
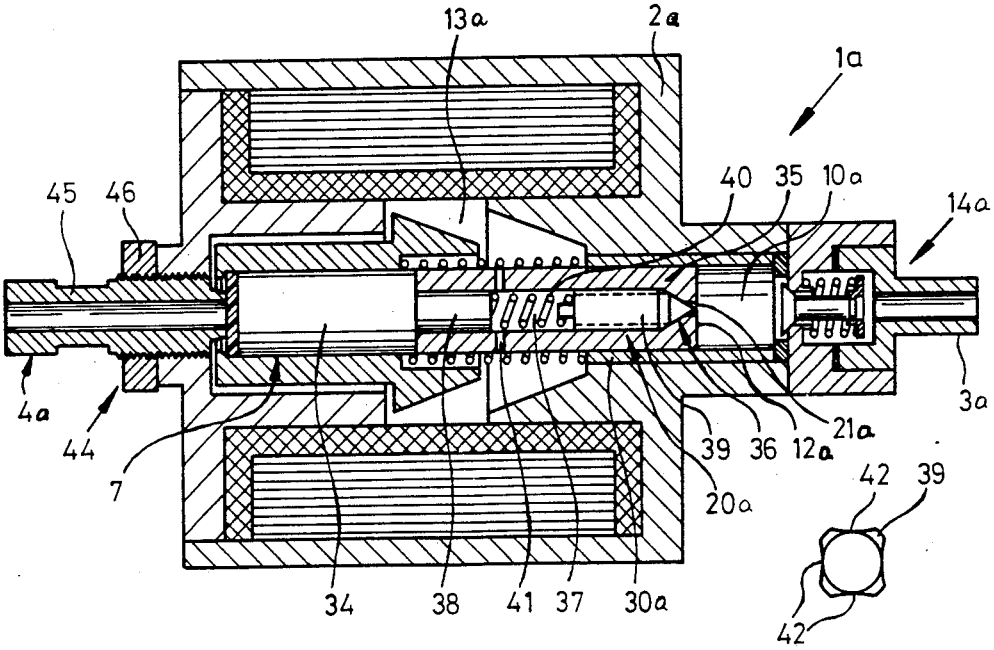
FIG. 4a

ELECTROMAGNETICALLY ACTIVATED PISTON PUMP

BACKGROUND AND SUMMARY OF THE INVENTION

The invention relates to an electromagnetically activated pump of the type finding particular application in the metered supply of fuel to burner devices, as for instance, to burners in fuel operated heating appliances.

German Offenlegungsschrift, No. 23 15 842 and U.S. Pat. No. 202,582 disclose electromagnetically activated piston fuel pumps particularly adapted for fuel burners, and German Patent No. 23 66 301 discloses a similar pump arrangement wherein the inlet and outlet are axially arranged across from each other. Pump activation is based on pulse frequency of a current supplied to a magnetic coil assembly, which frequency effects the stroke of the piston. A return spring returns the piston in the opposite direction. During its stroke, the piston expels the fuel at the outlet via a self-opening pressure valve, while simultaneously opening a valve at the inlet so that fluid medium, i.e., the medium being pumped, such as fuel, enters the piston pump and flows along the outside of the piston in an axial direction. At the end of the delivery stroke, the piston reverses its direction of movement and the flow medium is displaced, during a working stroke in the pump, to a cylindrical chamber, the fluid medium entering from an armature compartment formed between the armature and the magnetic coil assembly, shortly before completion of the piston return movement. After completion of the piston return movement, the valve at the inlet is closed during the working stroke.

In this piston pump, the valve at the inlet may open itself in the inactive position of the piston, e.g., when the piston pump is turned off, as a function of the supply pressure, thereby permitting the fluid medium to enter the pump in a manner causing pressure to be applied to the self-opening pressure valve with the result that there is no longer a complete closure of the pump outlet. Furthermore, the ability of the valve at the inlet to completely close depends only upon the spring force exerted by the return spring, which can be overcome when there is corresponding supply pressure.

Another drawback of such pumps is that when the fluid medium is gasoline, a considerable out-gassing takes place within such pumps, which is even more intensified as the fluid medium is displaced by way of grooves in the pump which have converging flow-through cross-sectional areas, and inasmuch as the fluid medium enters the cylindrical chamber during displacement, only at the end of the working stroke movement, which movement is counter to the return movement of the piston. Consequently, during this working stroke, negative pressure is created for intake into in the inlet zone, which promotes out-gassing of the fuel, and inherently promotes formation of vapor bubbles. The formation of such vapor bubbles in the piston pump results in an uneven flow supply at the outlet of the piston pump which, in turn, can lead to operating disturbances in the burner devices.

It is, therefore, a primary object of the invention to overcome the above described drawbacks and problems and to provide an electromagnetically activated piston pump which delivers a uniform flow substantially free of bubbles, and permits a reliable complete closure.

In accordance with the invention, the design of the electromagnetically activated piston pump is such that, at the inlet of the piston pump, there is a suction valve leading to a suction chamber, which valve is opened by pressure a differential acting on the suction valve. Furthermore, the piston, energized by the magnetic coil assembly, executes a working stroke for displacement of the fluid medium from the suction chamber, via a relief valve, to the armature compartment. During the return movement of the piston for executing the delivery stroke, the fluid medium is expelled from the armature compartment to the outlet, with the relief valve in a blocked position. Immediately at the outset of this counter-current movement of the piston, the suction valve opens and the suction chamber is again filled with fluid medium.

As, moreover, the suction chamber can again fill with fluid medium via the suction valve at the beginning of the return movement of the plunger for the execution of the delivery stroke, the fluid medium is introduced into the suction chamber with as low a negative pressure as possible, in order to avoid bubble formation. Furthermore, the inventive design is such that there is complete closure in the area of the pump outlet in order to make sure that, particularly in this basic or inactive position of the plunger pump, no fluid medium is delivered, thereby assuring operational safety of the burners supplied by such piston pumps.

Even if the fluid medium should enter at the inlet of the piston pump of the present invention, the valve producing the outlet closure is acted upon in a closing direction by any flow medium which might enter, via the piston and armature, causing an even tighter sealing thereof. This also has the advantage that the complete closure at the outlet is intensified by the fluid medium itself, if there is excessive supply pressure, ensuring tight sealing of the outlet in the idle position. As the armature compartment and the suction chamber are separated by the relief valve, the metered volume of the fluid medium, determined by the suction chamber, cannot change, even if there is a possible formation of vapor bubbles caused by either the displacement action, or by heating of the armature compartment.

The preferred arrangement of the suction valve, with regard to the piston, and particularly to its work stroke limiting positions, permits an extremely advantageous construction of the housing arrangement, making the utmost use of the specified available installation space, while ensuring reliable performance of their functions on a long term basis.

In order to extensively reduce the supply pressure dependency of the piston pump, the outlet of the suction valve, preferably at the end of the working stroke displacement, is overlapped by the piston itself, so that this outlet is blocked off by the position of the piston, without additional measures. In order to avoid having to resort to additional measures for a forced opening of the relief valve in the area of the working stroke limiting position of the piston, the inactive flow volume in the area of the suction valve is reduced, in that the suction valve is a poppet value, and in that the value seat is disposed at the discharge area of the suction chamber. The poppet valve is biased into its closed position by a spring.

Preferably, resilient stops are provided for the stroke limiting positions of the piston for the purpose of noise reduction.

The spring biased relief valve, preferably, may be a ball valve, a conical seat valve, or, especially, a needle valve which has the advantage that the inactive flow volume in the area of the relief valve may be kept to a minimum.

According to one modification in accordance with the invention, the relief valve is arranged in a cylindrical housing, which design simplifies the manufacture of the piston as one solid component, thereby simplifying the manufacture and attachment of the armature, and finally permitting the relief valve and the suction valve to be disposed at areas easily accessible from the exterior of the piston pump where, therefore, if necessary, they can be easily exchanged or repaired. Additionally, a transit channel can easily be provided in the housing of the pump, which creates a connection between the outlet of the relief valve and the armature compartment. Appropriately, this transit channel is formed by a minimum of one through-bore in the cylindrical housing, which extends parallel to the piston axis.

In a preferred embodiment of the invention, the suction valve is disposed extending axially to the piston, and the relief valve is disposed in the housing so as to be perpendicularly oriented and laterally situated relative to the suction valve. The inlet to the relief valve is in the side of the suction chamber. As the piston approaches the end of its fuel delivery stroke, the piston increasingly overlaps the inlet leading to the relief valve, so that the cross-sectional area of the inlet opening is reduced and the moving speed of the piston can be reduced, resulting in a lower impact speed of the piston at the stop. At the same time, such a design enables the valve head of the suction valve to serve as a stroke limiting device, thereby combining two functions in the valve head and further creating a minimum of inactive flow volume.

If, according to an alternative embodiment of the invention, the relief valve is arranged in the housing so as to be oriented in the axial direction of the piston, and the suction valve is oriented normal thereto, i.e., pointing to the side, if necessary a forced opening of the relief valve, at the stroke end of the piston working stroke, can easily be realized, if there is design-conditioned unavoidable inactive flow volume. This forced opening can be achieved by having an extension of the valve nose project into the suction chamber, so that the piston will open the relief valve by contacting the extended valve nose before the plunger reaches the end of its stroke.

When the relief valve is arranged at the side of the housing, the transit channel to the armature compartment can easily be provided by a constructional design which leaves an annular clearance free for forming an annulus between two housing parts, whereby the suction valve is arranged in one housing part, and the relief valve is disposed in a second housing part, complementary thereto.

According to a further embodiment of the invention, the arrangement is such that at least a portion of the piston, and, preferably, the inlet end of the piston facing the suction valve, comprises a hollow space which serves to displace the flow medium from the suction chamber to the armature compartment and contains the relief valve. In such a design, a short valve element with a small inertial mass can be used for reducing the opening pressure. Simultaneously, a constructionally simple design of the housing is achieved since, in such an embodiment, the displacement of the fluid medium to the armature compartment occurs via the hollow space in the piston so that no transit channels or connections from the suction chamber to the armature compartment have to be provided through the housing. Such a design further makes it unnecessary for the housing to contain the relief valve. In order to keep the inactive flow volume to a minimum, which otherwise could present difficulties with respect to gas delivery, a needle type relief valve is arranged with its valve seat in the vicinity of the front area of the inlet end of the piston.

When such design is adopted, particularly when the suction valve is in the form of a poppet valve, the inactive flow volume obtained is negligible with regard to the functioning of the pump in connection with the gas delivery, so that no additional measures have to be taken to ensure a forced opening of the relief valve immediately at the end of the working stroke of the piston pump. As such a design provides that the fluid medium is guided through the hollow space of the piston during displacement, out-gassing of the fluid medium during displacement can be prevented, or extensively be kept to a minimum.

A particularly uncomplicated construction of a piston having a hollow space is obtained when that part of the piston facing the outlet is a solid component, provided with a step-like extension, onto which a casing is placed for the formation of the hollow space. Such a design also offers the advantage that the valve needle of the needle valve can be secured in a spring, which biases it into a closed position, between the needle element and the reduced diameter section of the solid piston, and that the needle valve structure can be simply inserted during the assembly of the casing and solid piston part. Further, the channel leading to the armature compartment may be designed as bores in the casing.

An alternative piston pump embodiment, in accordance with the invention, is characterized in that the entire piston is hollow. In such design, the relief valve is appropriately disposed in the inner chamber formed by the hollow piston, in the vicinity of the outlet side end thereof. The armature can be rigidly connected with the hollow piston and there may be several connecting channels therein which create a connection to the armature compartment during displacement.

In such an arrangement, however, there is a relatively large inactive flow volume formed by the inner cavity of the hollow piston so that a forced opening of the relief valve at the end of the piston working stroke is necessary to preclude difficulties in connection with the conveyance of gas. To this end, an activating element which contacts the relief valve is arranged in the hollow space of the hollow piston in such a manner that it opens the relief valve at the end of the piston working stroke as a consequence of the activating element engaging against the front facing side of the pump inlet, thereby forcing the valve element of the relief valve into its open position.

In a coaxial arrangement of the inlet and outlet of the piston, in order to suppress the supply pressure dependency of such a piston pump, the outlet of the suction valve, at the end of the working stroke, is overlapped by the hollow piston itself so that, during the forced opening of the relief valve caused by the actuating element, discharging from the inlet into the suction chamber is reliably blocked.

Appropriately, the actuating element, particularly at the end facing the inlet valve, is disposed such that it forms a seal for blocking the outlet at the end of the working stroke. This causes the actuating element to simultaneously perform the function of a valve element for blocking the outlet of the suction valve during the forced valve opening of the relief valve, ensuring independence from supply pressure. This seal provided at the end of the suction valve facing the outlet is pressed against the outlet of the suction valve during the forced valve opening.

In a further refinement of this design, the valve seat of the relief valve is directly disposed at the end of the outlet side of the hollow piston, and the valve element is provided on the actuating member. Such an arrangement simplifies the construction and the design of the relief valve, having a forced opening part, as the actuating element simultaneously is disposed and functions as a valve element at its end that faces away from the inlet.

In order to achieve a stroke synchronization for the piston of the pump in a simple manner, a design provision for an axially adjustable outlet connection is applicable for all forms of the piston pumps, and can, for instance, be positioned in the area of the outlet by way of a retaining nut, at a predetermined axial point.

Finally, means may be provided for preventing fluctuations in the flow volume, to be displaced by the piston, which fluctuations might occur in connection with the expansion of the resilient stops at the end positions of the piston. To this end, in order to obtain a flow volume that is as uniform as possible, a bypass channel is provided that terminates at the inlet to the suction chamber, at an axial distance from the outlet of the suction valve, and which communicates with the inlet line upstream of the suction valve. In this case, the volume of fluid medium to be conveyed to the armature compartment is not determined by the end position of the piston. Instead, the volume displaced at the piston pump is predetermined by the axial distance of the bypass channel discharge opening into the suction chamber from the inlet, permitting a predetermined volume to be displaced in the piston pump, independent of any expansion of the resilient stop at the end of the working stroke. This particularly eliminates the flow fluctuations which are the result of temperature changes of the piston pump and/or of expansion of the resilient stops in the end positions of the piston displacement.

At the outset of the discharge process, the flow medium is returned upstream again to the inlet line via the bypass channel process, until the piston travels over the discharge opening of the bypass channel in the suction chamber. At that point, flow medium is then fed downstream so that the flow volume that is displaced corresponds to the volume which is contained between the front wall of the suction chamber and the piston at the point where the piston seals the bypass channel outlet. The selection of the axial distance at the outlet opening of the bypass channel into the suction chamber from the front wall of the suction chamber permits the displacement volume, and thereby the flow quantity delivered by the plunger pump, to be varied and adjusted. When also the relief valve opens into the suction chamber, the flow volume is extensively independent of the expansion effects of the two resilient stops, so that the displacement volume and the respective flow quantity are determined by that volume which is confined between the discharge opening of the bypass channel and the inlet opening of the relief valve in the suction chamber. The flow volume in the suction chamber is determined by control edges rather than the end positions of the piston.

If no displacement is desired, the relief valve can be an outlet valve, like a pressure valve. As a result the advantages, previously discussed, are obtained, relative to flow delivery by the outlet valve.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 2 is a partial axial sectional view of a variation of the electromagnetic piston pump according to FIG. 1;

FIG. 4 is an axial sectional view of another preferred embodiment of an electromagnetically activated piston pump having a partially hollow piston in accordance with the invention with FIG. 4*a* illustrating a top view of a valve needle thereof;

DETAILED DESCRIPTION OF THE PREFERRED EMBODIMENTS

Figure 1:
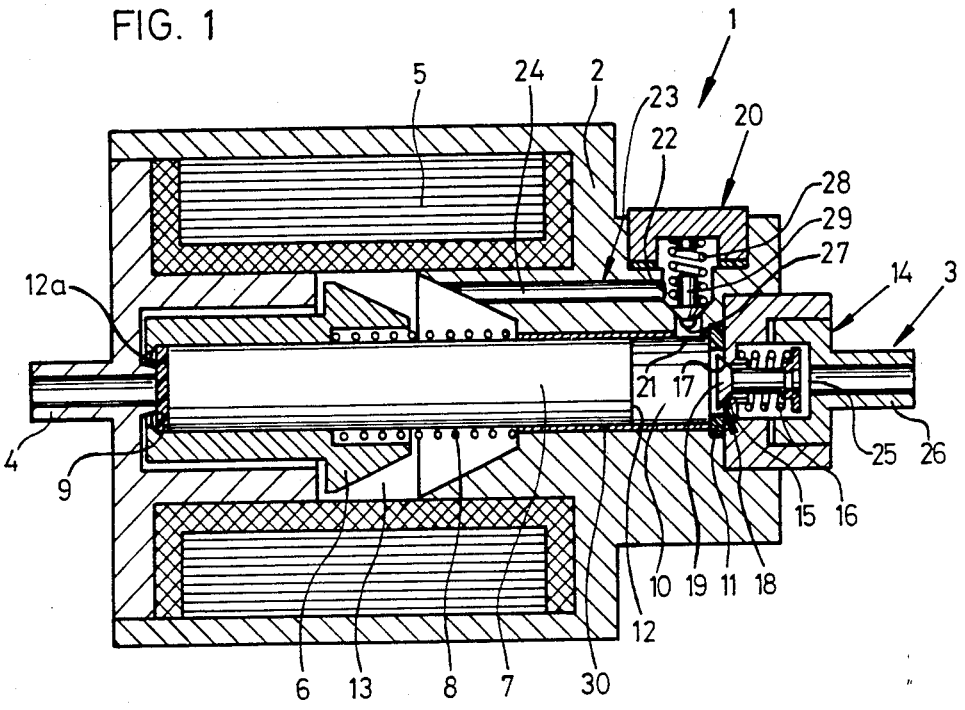
FIG. 1 is an axial sectional view of an electromagnetically activated piston pump in accordance with a preferred embodiment of the invention.

FIG. 1 shows a first embodiment of an electromagnetically activated piston pump, in accordance with the present invention, which is particularly adapted to discharge a metered supply of fuel to burner devices, e.g., a heater. The piston pump, as a whole, is designated by numeral 1. Pump 1 has a housing 2 with an inlet 3, as well as an outlet 4 which, in this embodiment, are in axial alignment with each other. Housing 2 contains a magnetic coil arrangement 5 of an electromagnet disposed so as to act upon an armature 6 which is attached to a piston. When energized, the electromagnet causes the armature 6, and with it the piston 7, to move to the right from its basic or inactive position shown in FIG. 1, executing a working stroke.

For the return of piston 7 into its basic position, depicted in FIG. 1, a return spring 8 is provided which, when electromagnetic coil arrangement 5 is de-energized upon completion of the working stroke of piston 7, returns the piston in such a manner that it causes a resilient stop 9 to bear against outlet 4 of the piston pump. In the basic position of plunger 7, depicted in FIG. 1, a suction chamber 10 is formed in the area of inlet 3 of piston pump 1, which suction chamber is bounded between the face area of the inlet end 12 of piston 7 and a resilient stop 11 disposed opposite piston end 12, at the inlet side of housing 2. Electromagnetic coil arrangement 5, armature 6, housing 2 and piston 7 define an armature compartment 13.

A suction valve 14 is disposed in inlet 3, coaxially with respect to the axis of piston 7. This suction valve 14 is a poppet valve 15 and is biased by way of spring 16 into its closed position, depicted in FIG. 1. Valve seat 17 of poppet valve 15 is disposed at discharge area 18 of inlet 3 in suction chamber 10. Valve head 19 of poppet valve 15 projects into suction chamber 10 and is circumferentially bordered by resilient stop 11, at inlet 3.

Housing 2 also has relief valve 20 whose inlet 21 opens into suction chamber 10 perpendicularly to inlet 3 of piston pump 1. An outlet 22 of relief valve 20 is connected with the armature compartment 13 via transit channel 23. This transit channel 23 is formed, in the embodiment depicted in FIG. 1, by a minimum of one bore 24, which is axially disposed in housing 2 parallel to the axis of piston 7. The relief valve 20 is a conical seat valve. It is to be understood that relief valve 20 may be of any other suitable valve construction, if desired. At the inlet of suction valve 14, there is an inlet line 26 via which a fluid medium, e.g., liquid fuel, can be supplied. Piston 7 is guided in a bushing 30, which, for instance, may be made of brass or a similar material.

The electromagnetically activated piston pump 1 depicted in FIG. 1 operates in the following manner. When starting from the basic position of piston 7, depicted in FIG. 1, magnetic coil arrangement 5 is energized, the electromagnetic interaction of armature 6 and electromagnetic coil arrangement 5, causes piston 7 to move to the right from the position depicted in the drawing. Prior thereto, suction chamber 10 was filled with fluid medium as a result of the pressure differential accumulating in suction valve 14 at inlet 3. In the working stroke movement of piston 7, which is directed to the right, with suction valve 14 in its closed position, the fluid medium, like fuel, is displaced from suction chamber 10, via relief valve 20, which is now open, and transit channel 23, to armature compartment 13.

During the movement of piston 7, inlet side piston end 12 gradually travels over inlet 21 of relief valve 20 so that the flow-through cross-sectional area at inlet 21 of relief valve 20 is gradually reduced, whereby the moving speed of piston 7 is also reduced. The end position of piston 7, in this working stroke which causes displacement of the fuel, is achieved when inlet side piston end 12 bears against resilient stop 11 with the interposition of a liquid pad. At this point, the entire liquid volume has been conveyed from suction chamber 10 to armature compartment 13 via relief valve 20 and transit channel 23.

Once the electromagnet is de-energized, the piston is acted upon by return spring 8 so that it is now moved in the opposite direction, e.g., in FIG. 1 to the left. During this return movement, piston 7 executes a delivery stroke by which fuel is displaced from armature compartment 13 through outlet 4 of piston pump 1.

Immediately at the start of the return movement of piston 7, suction valve 14 is opened again, affected by the pressure differential built-up between suction chamber 10 and inlet line 26, whereby, fuel flows into suction chamber 10 at the very beginning of the return stroke of piston 7, without creating any significant negative pressure. At the end of the return delivery stroke, piston 7 again resumes the basic position depicted in FIG. 1, in which outlet 4 is blocked by end 12*a* of piston 7, which bears resilient stop 9 against outlet 4. These resilient stops 9, 11 at the end positions of piston 7 serve the purpose of reducing noise by avoiding metal-to-metal contact at these end positions. Accordingly, piston pump 1 operates with an extremely low noise level. Inasmuch as suction chamber 10 of piston pump 1 is refilled with fuel, commencing at the outset of the return movement of piston 7, without a build-up of significant amounts of underpressure in suction chamber 10, bubble formation due to out-gassing of fuel (serving as the fluid medium) is avoided. A forced opening of relief valve 20 at the end of the working stroke of piston 7 is unnecessary as relief valve 20 and suction valve 14 only form negligible inactive flow volumes.

A complete closure of piston pump 1 is achieved in the area of outlet 4 when piston 7 has been returned to its basic position by return spring 8. If, for instance, piston pump 1 has been shut off and fuel still enters suction chamber 10, caused by an opening of suction valve 14 due to the supply pressure of fuel delivered via inlet line 26, this fuel in suction chamber 10 contacts inlet piston end 12, causing piston 7, and with it resilient stop 9, to bear more strongly upon outlet 4 than would be possible by the effects of return spring 8 alone. This action results in an increase of the closure pressure at outlet 4 of piston pump 1 in that the fuel in suction chamber 10 intensifies the effectiveness of return spring 8. This ensures that piston pump 1, in its shut-off condition, does not supply any fuel via outlet 4, which outlet, for instance can lead to a fuel operated heating device, not depicted in detail in the drawing. The above feature is necessary for considerations of operational safety.

Since out-gassing of fuel is prevented while filling suction chamber 10, as well as in the displacement of fuel from suction chamber 10 to armature compartment 13, a predetermined amount of continuous flow of liquid, which is substantially free of gas bubbles, is achieved at outlet 4 during the delivery stroke of piston 7. This, in turn, ensures a uniform supply of fuel, for instance, to the downstream user unit, such as a heating device.

FIG. 2 depicts, in greater detail, the area around suction valve 14 and relief valve 20. Parts that are identical or similar to parts shown in FIG. 1 have the same reference numerals. In this variation, suction valve 14 is disposed in a bushing 30 which serves to guide piston 7. Bushing 30 also contains inlet 21 of relief valve 20 and forms suction chamber 10. Furthermore, bushing 30 is surrounded by housing 2 in such a manner that annulus 31 is formed between the outer side of bushing 30 and the inner side of housing 2 which serves as transit channel 23 communicating outlet 22 of relief valve 20 with armature compartment 13. Accordingly, in the variation depicted in FIG. 2, in contrast to FIG. 1, a bore 24 for the formation of transit channel 23 is unnecessary, as a result of the easy to manufacture design wherein transit channel 23 is formed by annulus 31.

Suction valve 14 and relief valve 20 in the piston pump, according to FIGS. 1 and 2, are easily accessible from the outside of housing 2 and can be quickly and easily exchanged and/or repaired in case of a malfunction. Appropriate design of the face area of valve head 19 of suction valve 14 facilitates that this valve can simultaneously serve as a stroke limiting device for the working stroke movement of piston 7.

Figure 3:
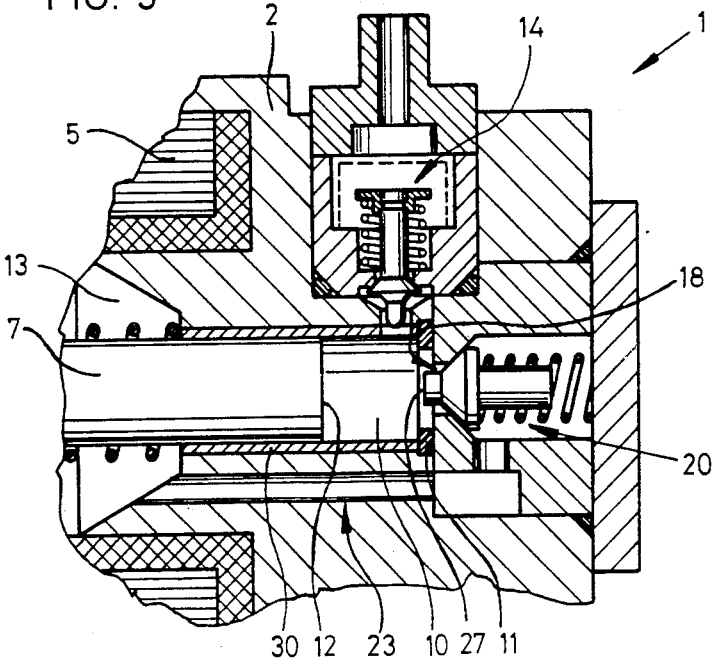
FIG. 3 is a partial sectional view, similar to FIG. 2, of another variation of the electromagnetic piston pump.

In the design of piston pump 1, depicted in FIG. 3, relief valve 20 is disposed in housing 2 so as to extend in axial alignment with piston 7. Suction valve 14 is arranged at the side of housing 2 extending normal to the axis of piston 7. Here again components that are the same or similar to those of FIG. 1 have been designated with identical reference numerals in FIG. 3. If this design variation requires a forced opening of relief valve 20 at the end of the working stroke of piston 7, as a result of the inactive flow volume of piston pump 1, this is easily achieved by having the valve nose 27 project slightly into suction chamber 10, through the resilient stop 11, so as to be contacted by the end of piston 7. In order that piston 7 will open relief valve 20 at the end of its working stroke displacement. This design also ensures that suction valve 14 is positively blocked at this discharge area 18, in the position of piston 7 at the end of its working stroke, due to the overlapping of this discharge area 18 with the surface of piston 7.

FIG. 4 shows an axial sectional view of another piston pump embodiment, in accordance with the present invention. As with previously mentioned variations of the first embodiment, identical or similar parts have been given identical reference numerals, except, in this case, distinguished by an "a" designation. In contrast to the previous variations, piston 7*a* of piston pump 1*a* is formed by a solid piston element 34 and a casing 35, so that inlet-side piston end 12*a* of piston 7*a* is formed by casing 35 as a hollow piston part. In order to reduce the inactive flow volumes and the inertial mass to be accelerated during the operation of piston pump 1*a*, the relief valve 20*a* is formed as a short needle valve 36 and is arranged in an inner space 37 of casing 35 at piston end 12*a*. Casing 35 is attached to a reduced diameter section 38 of solid piston part 34, and a spring 40 is located between the face area of this reduced diameter section 38 and a valve needle 39 of needle valve 36. Spring 40 contacts valve needle 39 in a manner biasing in a direction closing needle valve 36. Moreover, radially extending channels 41 are provided in casing 35, which connect inner space 37 in casing 35 with armature compartment 13*a*.

During the working stroke movement of piston 7*a*, the flow medium is conveyed from suction chamber 10*a* to armature compartment 13*a*, via inner space 37 and (with the needle valve 36, functioning in the manner of relief valve 20, being in an open position) via radially extending channels 41, i.e., the flow travels counter to the movement of piston 7*a*. As in the previously discussed embodiment of the invention, during the return piston delivery stroke, the fluid medium is expelled from armature compartment 13*a* via outlet 4*a* of piston pump 1*a*, whereby immediately at the outlet of the return movement of piston 7*a*, suction chamber 10*a* is continuously refilled with fluid medium via suction valve 14*a* during the return stroke of piston 7*a*. Since needle valve 36 is provided in the vicinity of the piston end 12*a*, on the inlet side, the inactive flow volume of relief valve 20*a* is also kept to a minimum.

In FIG. 4*a*, the valve needle 39 of needle valve 36 is depicted in top view. Valve needle 39 has, in accordance with this illustration, a design such that, in the closed position of needle valve 36 depicted in FIG. 4, it effectively blocks inlet 21*a*, while at the beginning of the opening movement of needle valve 36 it opens a passage for the flow medium from suction chamber 10 to inner space 37 of casing 35 via the peripheral sections 42. This facilitates that, at the beginning of the working stroke of piston 7*a*, there is a through-flow cross section at needle 36 for displacement of fluid medium from suction chamber 10 to armature compartment 13, permitting flow medium to enter inner space 37.

In a further development of the invention, there is a stroke synchronization device, which is depicted in the left half of FIG. 4 and is referenced with numeral 44. It is to be understood that this device is applicable to the previously described variations of pump 1, as well as variations which are discussed below.

Outlet 4 is formed by an outlet connection 45 which is screwed into housing 2*a* with a retaining nut 46. The axial penetration of outlet connection 45 can be varied, whereby the basic/return end position (left in Figure) of piston 7*a* is also varied accordingly. Therefore, the stroke of piston 7*a* of piston pump 1*a* can easily be adjusted to the requirements at hand by means of stroke synchronization device 44, particularly compensating for tolerance-conditioned dimensional changes.

Figure 5:
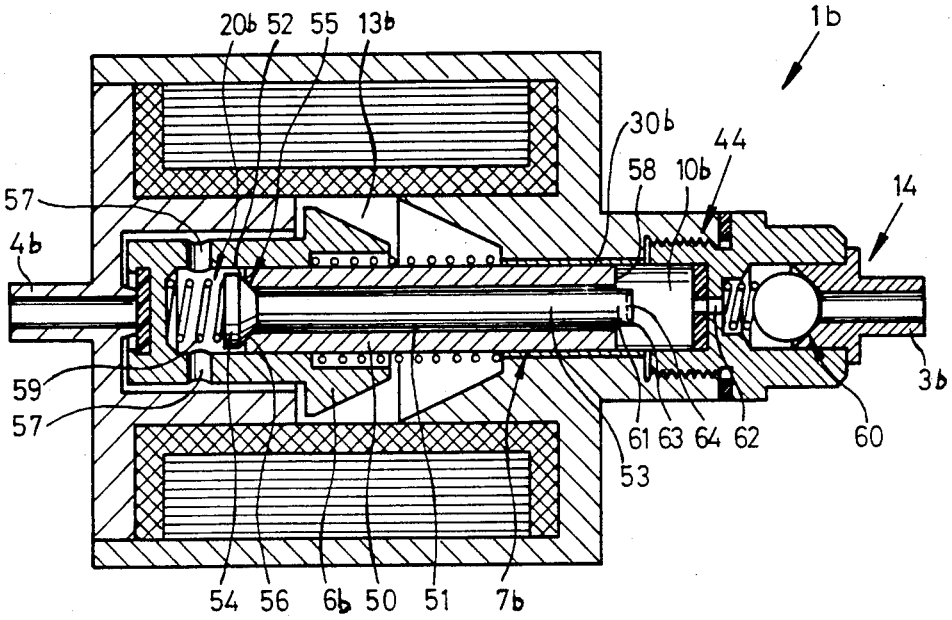
FIG. 5 is an axial sectional view of a further embodiment of the electromagnetic piston pump having a hollow piston.

FIG. 5 shows, in axial section, another embodiment of the piston pump, which is designated by reference numeral 1*b*, with parts that are identical or similar to parts of preceding embodiments having identical reference numerals, but distinguished by the suffix b. This piston pump 1*b* is substantially different in that piston 7*b* comprises a hollow piston 50 having an inner cavity 51 that contains a relief valve 20*b* in the vicinity of the outlet side end 52 of hollow piston 50. In this embodiment, however, a relatively large inactive flow volume area in the inner space 51, up to relief valve 20, has to be tolerated. This inactive flow volume area may fill with gas which, unlike liquid, is compressible. If gas is contained in inner cavity 51 without the ability to be withdrawn, this may cause disturbance of the self-priming ability of the pump. In order to ensure such a self-priming ability, piston pump 1*b* has an activator 53 which is in the shape of a rod extending through inner chamber 51 of hollow piston 50.

In the embodiment depicted in FIG. 5, the activator 53 is an extension of valve element 54 of relief valve 20*b*, which is a conical seat valve 55. The associated valve seat area 56 of conical seat valve 55 is located directly at the outlet end 52 of hollow piston 50, at which hollow piston 50 is secured to armature 6*b*. The armature 6*b*, itself, contains radially extending channels 57 which create a connection to armature compartment 13*b* for the displacement of fluid medium from suction chamber 10*b* to armature compartment 13*b*.

Fluid displacement from chamber 10*b* to compartment 13*b* takes place during the movement of hollow piston 50 (rightward with reference to FIG. 5), which causes the flow medium from suction chamber 10 to flow through inner chamber 51 via open relief valve 20*b* and radially extending channels 57 into armature compartment 13*b*. To facilitate opening of relief valve 20*b*, in the vicinity of the rightward end position, i.e., at the end of the working stroke of hollow piston 50, activator 53 protrudes by a predetermined degree beyond inlet end 58 of hollow piston 50, so that, before reaching the end position, it re-opens conical seat valve 55, overcoming the effect of spring 59 which biases conical seat valve 55 into its closed position. Thus, gas which may be present, but due to its compressibility allows the valve to close or remain closed, can escape as a result of this forced opening of valve 55, enabling it to be passed to outlet 4*b* during the return delivery return stroke of hollow piston 50.

In FIG. 5, suction valve 14*b* is a ball valve 60, which is similar in design to a check valve.

As is further shown in FIG. 5, end portion 61 of activator 53, i.e., the end portion facing the outlet of ball valve 60, is formed as a sealing edge 63. During the forced opening of valve 55, i.e., shortly before completion of the movement of hollow piston 50, which in accordance with FIG. 5 is directed to the right, sealing edge 63 securely blocks outlet 62 of ball valve 60 preventing fluid medium from entering via inlet 3*b*. Sealing edge 63 is formed by an indentation 64 in end portion 61 of activator 53.

FIG. 5 also shows a stroke synchronization device 44, indicated by dotted lines, which is disposed at inlet 3. This illustration is to indicate that the stroke synchronization device depicted by numeral 44 in FIG. 4 may be provided, not only at outlet 40, but instead may be provided at inlet 30, as indicated in FIG. 5.

Figure 6:
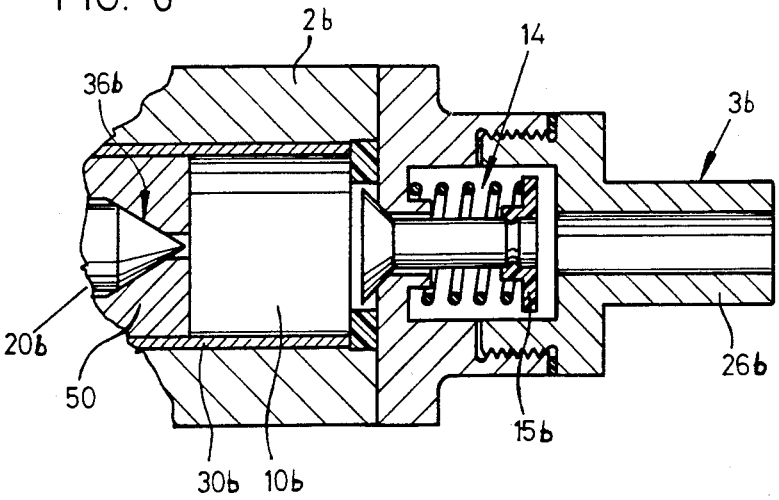
FIG. 6 is a partial sectional view illustrating refinements of the relief valve and suction valve of a piston pump having a hollow piston.

FIG. 6 shows a sectional view of a variation of piston pump 1*b* in accordance with FIG. 5.

In order to minimize the inactive flow volume of piston pump 1*b*, relief valve 20*b* here, in a variation similar to that of FIG. 4, is a needle valve 36. Also, a suction valve 14*b*, like the design according to FIGS. 1 and 2, is a poppet valve 15*b*. Such a design does not necessitate a forced opening, which eliminates the requirement for an activator element 53. All remaining parts of plunger 1*b* may be constructed as shown in FIG. 5.

Figure 7:
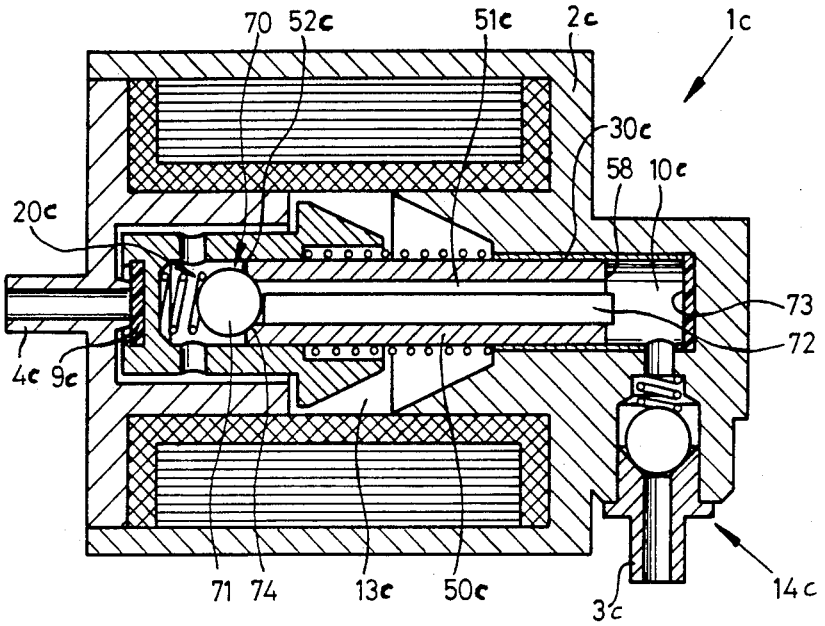
FIG. 7 is an axial sectional view of a variation of a hollow piston electromagnetically activated piston pump.

FIG. 7 shows a design of a piston pump according to FIG. 5, designated 1*c*. Suction valve 14*c* here, unlike in the FIG. 5 design, is not arranged in axial alignment with hollow piston 50, but is, instead, perpendicular thereto, i.e., laterally directed in housing 20. Moreover, relief valve 20*c* is a ball valve 70 and contains a movable valve ball 71. Reference numeral 72 of FIG. 7 depicts a movable activating element which facilitates forced opening of ball valve 70 at the end of the working stroke of hollow 50*c* and is disposed freely movably within inner space 51*c* of hollow piston 50*c*. The length of this actuating element 72 is such that it protrudes beyond inlet side end 58*c* of hollow piston 50*c* so that when it bears against an axial front area 73, which forms an end wall of the suction chamber 10*c*, it lifts valve ball 72 off the associated valve seat 74 at the outlet end 52*c* of hollow piston 50*c* prior to the inlet side end 58*c* of the hollow piston 50 bearing against this axial front area 73. The operation of piston pump 1*c* otherwise essentially conforms to that of piston pump 1*b*.

Figure 8:
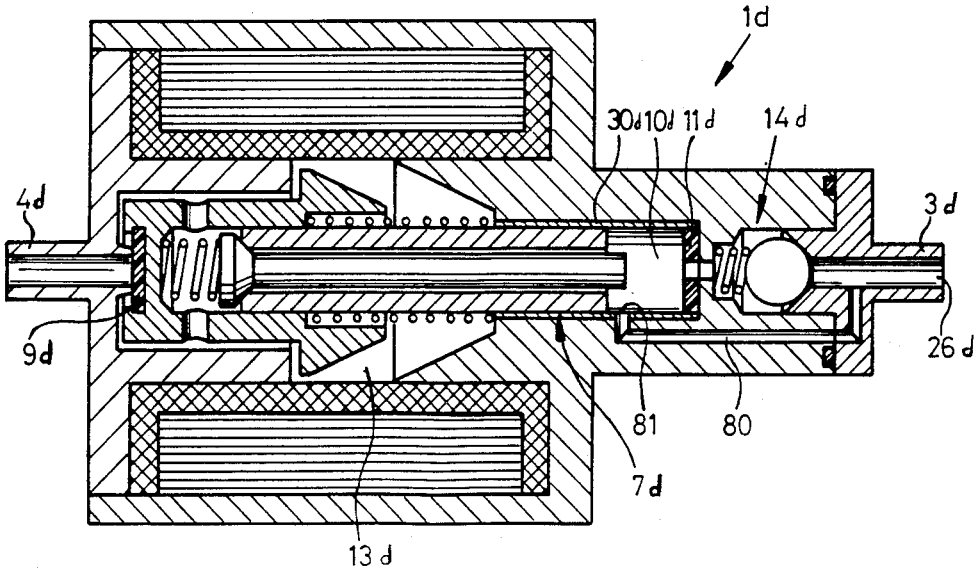
FIG. 8 is an axial sectional view of an embodiment of an electromagnetically activated piston pump having an inlet valve bypass.

FIG. 8 is a schematic illustration of a further embodiment of an electromagnetically activated piston pump, designated 1*d* in its entirety. This embodiment is essentially identical to that of FIG. 5 except that this piston pump 1*d* has a bypass channel 80 which starts at suction chamber 10*d* and terminates at a point that is situated an axial distance from inlet 3*d*, in communication with inlet 26*d* upstream of suction valve 14*d*. As a result, the volume of fluid medium which is displaced in a stroke of this piston pump 1*d*, from suction chamber 10*d* into armature compartment 13*d*, is not determined by the end position of piston 7*d*, as is the case with the previous embodiments. Instead, the volume displaced in piston pump 1*d* is determined by the position of opening 81 of bypass channel 80 in suction chamber 10.

Starting from the FIG. 8 basic position of piston 7*d* (which, for example, may be of the hollow piston design illustrated or may be one of the other design variations previously discussed), the piston depicted in FIG. 8 moves to the right causing displacement of fluid medium from suction chamber 10*d* to inlet line 26*d* via bypass channel 80. The connection to inlet line 26*d* is only blocked when piston 7*d* overruns opening 81 of bypass channel 80, the flow medium volume contained in suction chamber 10*d*, thereafter, being displaced to armature compartment 13*d* during the remainder of working stroke of piston 7*d*. The design of piston pump 1*d* ensures that a predetermined volume of the pump is always reliably displaced, and as a consequence, is discharged during the delivery stroke of plunger 7*d*, via outlet 4*d*, independent of such considerations as tolerances and expansion of resilient stop lid at the end position of piston 7*d*. Another advantage of such a design is that fluctuations in volume, which may be due to temperature variations in piston pump 1*d*, can be compensated for. Appropriate arrangement of opening 81 of bypass channel 80 facilitates the ability to vary the flow volume of the piston pump and adapt it to the requirements at hand, if necessary.

Figure 9:
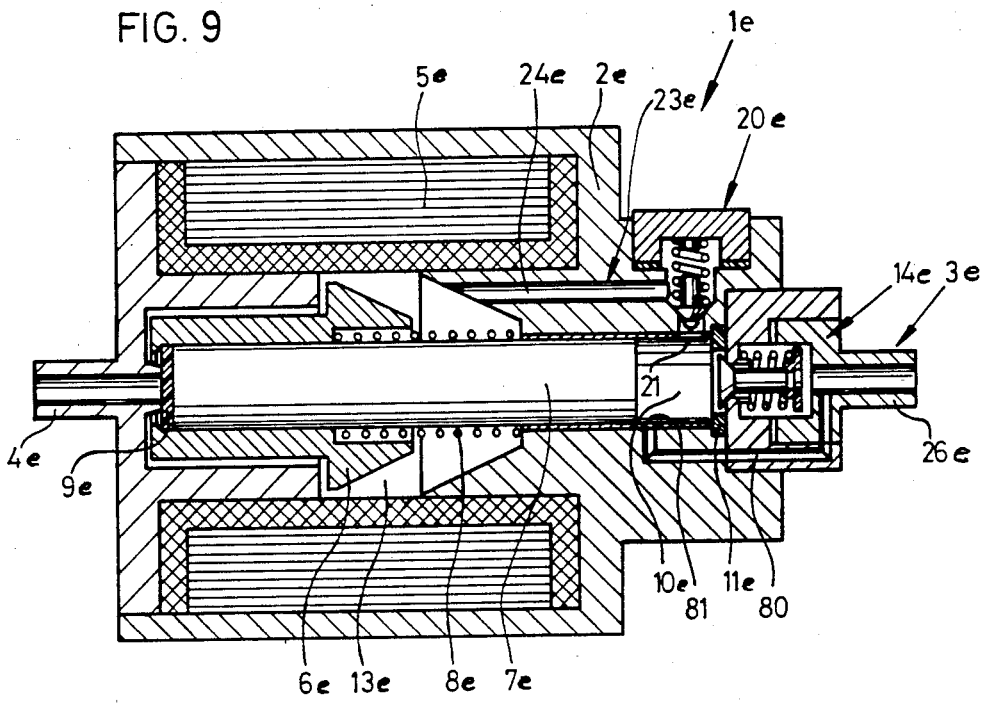
FIG. 9 is an alternative embodiment of electromagnetically activated piston pump with an inlet bypass in axial sectional view.

Another embodiment of a piston pump, referenced 1*e*, is schematically depicted in FIG. 9. Similar to the designs in accordance with FIGS. 1 to 3, piston 7 is a solid piston, and, as in the FIG. 8 embodiment, a bypass channel 80 is provided, which communicates inlet line 26 with suction chamber 10*c*. The inlet 21*e* of relief valve 20*e* of piston pump 1*e* leads from suction chamber 10 and is disposed at an axial distance from bypass opening 81*e* of bypass channel 80*e*, as well as being axially spaced from the suction valve 14*c* in pump inlet 3*e*. The flow volume displaced via relief valve 20*e* during the working stroke of piston 7*e* (which in accordance with FIG. 9 is executed to the right) is determined by that flow volume which is contained in suction chamber 10*e* between bypass opening 81*e* of bypass channel 80*e* and inlet 21*e* of relief valve 20*e*. As a consequence, piston pump 1*e* permits utilization of resilient stops 9*e*, 11*e* at the two end positions of piston 7*e* for the purpose of noise reduction, without incurring changes in the pump's flow volume as a result of expansion of resilient stops 9*e*, 11*e*. Accordingly, such a design of piston pump 1*e* affords a continuous and uniform flow volume which is independent of the expansion of the resilient stops.

If no displacement action is desired, transit channel 23*e* of FIG. 9 can be eliminated, and relief valve 20*e* can be replaced by an outlet valve, so that the fluid medium in suction chamber 10 is directly conveyed to the outlet via the inlet valve.

Although not depicted in detail, the effective work directions of the spring and magnetic coil arrangement 5 can be reversed, if desired, i.e., spring 8 can be disposed on the left side of armature 6 to bias it rightward and the electromagnet may be used to return the piston leftward.

While I have shown and described various embodiments in accordance with the present invention, it is understood that the same is not limited thereto, modifications as known to those skilled in the art, and I, therefore, do not wish to be limited to the details shown and described herein, but intend to cover all such changes and modifications as are encompassed by the scope of the appended claims.

We claim:

1. Electromagnetically activated piston pump of the type for use in the metered supply of fuel to burner devices, comprising a piston connected with an armature and arranged in a housing for reciprocal movement, an electromagnetic coil disposed about said armature, a return spring in biasing relation to said armature and piston, and flow passage means, including an armature compartment, for channeling a fluid flow from a suction side inlet to a pressure side outlet of the piston pump, via said armature compartment, the armature compartment being disposed between the armature and the electromagnetic coil; wherein a suction valve having an outlet leading into a suction chamber is arranged in an inlet line; wherein the electromagnetic coil is a means for producing a piston working stroke, during which said piston forms a means for displacing a fluid medium from the suction chamber via a relief valve to the armature compartment; wherein the return spring is a means for producing a piston delivery stroke, during which the piston forms a means for expelling the fluid medium from the armature compartment to the pump outlet with the relief valve in a flow blocking position; and wherein the suction valve is a means for filling of the suction chamber with the fluid medium at the beginning of the piston delivery stroke.

2. Piston pump according to claim 1, wherein an outlet of the suction valve opens into the suction chamber at a position which, during pump operation, is in the vicinity of a piston end position of the working stroke.

3. Piston pump according to claim 2, wherein the suction valve is disposed in axial alignment with the piston.

4. Piston pump according to claim 2, wherein the suction valve is disposed perpendicularly to the axial direction of the piston.

5. Piston pump according to claim 4, wherein the outlet of the suction valve is overlapped by the piston at the end of its working stroke.

6. Piston pump according to claim 1, wherein the suction valve has a valve head that is biased into a closed position by a spring and a valve seat is disposed at the suction chamber.

7. Piston pump according to claim 1, wherein resilient stops are provided for engaging ends of the piston at the end of the working stroke and end of the delivery stroke for purposes of noise reduction.

8. Piston pump according to claim 1, wherein an outlet end of said piston is constructed and arranged in said housing as a means for blocking the pump outlet at a position corresponding to the end of said delivery stroke.

9. Piston pump according to claim 1, wherein said relief valve is spring-biased.

10. Piston pump according to claim 9, wherein the relief valve is a ball valve.

11. Piston pump according to claim 9, wherein the relief valve is a conical seat valve.

12. Piston pump according to claim 9, wherein the relief valve is a needle valve.

13. Piston pump according to claim 1, wherein the relief valve is disposed in said housing, has an inlet opening into said suction chamber and an outlet communicating with the armature compartment via a transit channel.

14. Piston pump according to claim 13, wherein the transit channel is formed by at least one through-bore which extends parallel to the piston and is located in said housing.

15. Piston pump according to claim 13, wherein the relief valve is oriented perpendicularly to the suction valve.

16. Piston pump according to claim 15, wherein relief valve is axially aligned with the piston.

17. Piston pump according to claim 13, wherein the housing is formed of at least two housing components and the transit channel is formed as an annulus between two of said housing components.

18. Piston pump according to claim 1, wherein the piston has a hollow space therein at least at an inlet side end thereof and said hollow space forms part of said flow passage means and contains said relief valve.

19. Piston pump according to claim 18, wherein the relief valve is disposed in the vicinity of the inlet side end of the piston and is a needle valve.

20. Piston pump according to claim 19, wherein the piston is formed by a hollow casing and a solid piston part, the casing being attached onto a step-like extension of the solid piston part so as to form said hollow space, and wherein the relief valve is disposed in the hollow casing with a spring interposed between the solid piston part and a valve needle of a needle valve of which the relief valve is comprised.

21. Piston pump according to claim 18, wherein the piston is hollow throughout its length.

22. Piston pump according to claim 21, wherein the relief valve is arranged at an outlet side end of the piston and an actuating element is disposed in said hollow space in a manner for forcibly opening the relief valve at the end of said working stroke of the piston.

23. Piston pump according to claim 22, wherein the actuating element is provided with an end directed toward the suction valve that has a sealing edge for blocking the outlet of the suction valve at the end of the working stroke of the piston.

24. Piston pump according to claim 22, wherein the outlet side end of the hollow piston is provided with a valve seat for and a valve element of the relief valve, and wherein the activating element is provided on said valve element.

25. Piston pump according to claim 1, comprising a flow line connection that is connected to said housing and is axially adjustable in a manner enabling it to form a means for piston stroke synchronization.

26. Piston pump according to claim 1, wherein the piston bears against an outlet suction valve in a basic position when the electromagnetic coil is deenergized, the electromagnetic coil being a means for shifting said piston from said basic position for performing said delivery stroke and said spring being a means for returning said piston back to said basis position during said working stroke.

27. Piston pump according to claim 1, wherein a bypass channel is provided which opens into the suction chamber and communicates the suction chamber with the inlet line upstream of the suction valve.

28. Piston pump according to claim 27, wherein the relief valve has an inlet in the suction chamber that is located at an axial distance from the point at which the bypass channel opens into the suction chamber, in the direction of the inlet.

29. Piston pump according to claim 28, wherein a pressure valve is provided as an outlet valve.

* * * * *